US007207932B1

(12) United States Patent
Dean

(10) Patent No.: US 7,207,932 B1
(45) Date of Patent: Apr. 24, 2007

(54) PORTABLE EXERCISE DEVICE FOR CUSHIONING AND SUPPORTING THE BODY WHILE EXERCISING

(76) Inventor: David Dean, 4021 Skidmore St., Ashland, KY (US) 41101

( * ) Notice: Subject to any disclaimer, the term of this patent is extended or adjusted under 35 U.S.C. 154(b) by 0 days.

(21) Appl. No.: 11/147,843

(22) Filed: Jun. 8, 2005

(51) Int. Cl.
*A63B 26/00* (2006.01)
*A63B 71/00* (2006.01)

(52) U.S. Cl. ..... 482/140; 482/148; 482/23; 482/907

(58) Field of Classification Search ..... 482/140, 482/142, 23, 148, 35, 91, 62, 907, 121–130; D21/676, 690, 665, 686, 797, 792, 798; D06/596; 2/267, 20, 24; 5/420, 500, 636, 690
See application file for complete search history.

(56) References Cited

U.S. PATENT DOCUMENTS

| | | | | |
|---|---|---|---|---|
| 2,533,273 A | | 12/1950 | MacGregor | 272/58 |
| 4,509,748 A | * | 4/1985 | Bezak | 482/140 |
| 5,033,742 A | | 7/1991 | Johnson et al. | 272/144 |
| 5,417,636 A | * | 5/1995 | Havens | 482/142 |
| 5,776,042 A | | 7/1998 | Szabo | 482/140 |
| 5,882,284 A | | 3/1999 | Cayne | 482/130 |
| 5,913,757 A | | 6/1999 | Winters | 482/140 |
| 5,931,768 A | | 8/1999 | Amesquita | 482/140 |
| 6,213,923 B1 | | 4/2001 | Cameron et al. | 482/142 |
| 6,322,485 B1 | * | 11/2001 | Marrero | 482/140 |
| 6,491,608 B1 | | 12/2002 | Stearns | 482/96 |
| 2004/0014570 A1 | * | 1/2004 | Centopani | 482/140 |

* cited by examiner

*Primary Examiner*—Lori Amerson
(74) *Attorney, Agent, or Firm*—Goldstein Law Offices P.C.

(57) ABSTRACT

An exercise device for cushioning and supporting a user while exercising and developing arm, leg, back, and abdominal muscles and reducing fat around the stomach and abdominal area. The exercise device has a pair of equally sized rectangular mats including an upper and a lower mat having a hinge connection for folding in half. Said mats have a top surface, a bottom surface, and side edges. The upper mat has two internally positioned flexible shafts, two adjustable straps extend upwardly from the upper mat, and an outwardly extending head support panel. The lower mat has two internally positioned, non-flexible shafts, two adjustable feet straps, and two grasping straps.

9 Claims, 4 Drawing Sheets

PORTABLE EXERCISE DEVICE FOR CUSHIONING AND SUPPORTING THE BODY WHILE EXERCISING

BACKGROUND OF THE INVENTION

The invention relates to an exercise device, and more particularly, to a portable exercise device for cushioning and supporting the body while developing arm, leg, back, and abdominal muscles and reduce fat around the stomach and abdominal area.

More and more Americans are becoming overweight and obese. During the 1990's, the incidence of people who were either obese or overweight increased regardless of age, education, race or gender. The reason for the increase is two pronged, lack of exercise and diet. Leading more sedentary lives than ever, Americans are also consuming more foods loaded with fat, calories and cholesterol. Much of the increased weight is developed around the stomach area and detracts from the physical appearance of individuals but there is much more to worry about than how that fat around the waist makes one look. Unlike fat around the hips, the fat around and above the waist is the kind associated with an increased risk of high blood pressure, heart disease, diabetes, and some cancers.

U.S. Pat. No. 5,033,742 to Johnson et al. discloses an inflatable sit-up exercise device for cushioning and supporting the body when used by an exerciser doing sit-up type exercises. U.S. Pat. No. 5,931,768 to Amesquita discloses an abdominal and lower back exercise apparatus having and elongated rigid member for positioning between a user's back and a support surface for executing a crunch. U.S. Pat. No. 6,491,608 to Stearns discloses an exercise machine having a platform on which a user is supported in a reclining position. U.S. Pat. No. 6,213,923 to Cameron et al. discloses a back exercise device and method for strengthening the muscles of lower back and abdomen. U.S. Pat. No. 2,533,273 to MacGregor discloses exercising equipment for use in reducing weight of the human body without objectionable loss of weight of the face and neck. U.S. Pat. No. 5,913,757 to Winters discloses a crunch abdomen exercise apparatus to facilitate the crunch abdomen exercise. U.S. Pat. No. 5,871,425 to Gvoich discloses an abdominal exercise device for exercising all of the major muscles comprising the upper and lower abdomen and back. U.S. Pat. No. 5,882,284 to Cayne discloses an abdominal exercising apparatus having a platform having two upwardly extending sidewalls. U.S. Pat. No. 5,776,042 to Szabo discloses an abdominal exercise device having two U-shaped frame members.

While these units may be suitable for the particular purpose employed, or for general use, they would not be as suitable for the purposes of the present invention as disclosed hereafter.

SUMMARY OF THE INVENTION

It is an object of the invention to produce a means for cushioning and supporting the body while developing arm, leg, back, and abdominal muscles and reducing fat around the stomach and abdominal area. Accordingly, the invention is an exercise device having two, equally sized, rectangular mats, including an upper and a lower mat, which are hingedly connected together for cushioning and supporting the body while exercising and developing arm, leg, back, and abdominal muscles and reducing fat around the stomach and abdominal area.

It is another object of the invention to provide an exercise device capable of supporting the neck while doing sit-ups. Accordingly, the upper mat of the invention is equipped with two internally positioned, flexible fiberglass shafts which function as a neck support and anchor for two straps which are grasped by the user during sit-up exercises.

It is another object of the invention to provide an exercise device capable of being used for leg lifts and stretches. Accordingly, the lower mat of the invention has two internally positioned, non-flexible shafts with feet straps attached for use during sit ups, leg lifts, and stretches.

It is another object of the invention to provide an exercise device capable of being folded for easy transport and storage. Accordingly, the rectangular mats of the invention conveniently fold up for easy transport and storage.

This invention is an exercise device for cushioning and supporting a user while exercising and developing arm, leg, back, and abdominal muscles and reducing fat around the stomach and abdominal area. The exercise device has a pair of equally sized rectangular mats including an upper and a lower mat having a hinge connection for folding in half. Said mats have a top surface, a bottom surface, and side edges. The upper mat has two internally positioned flexible shafts, two adjustable straps extend upwardly from the upper mat, and an outwardly extending head support panel. The lower mat has two internally positioned, non-flexible shafts, two adjustable feet straps, and two grasping straps.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
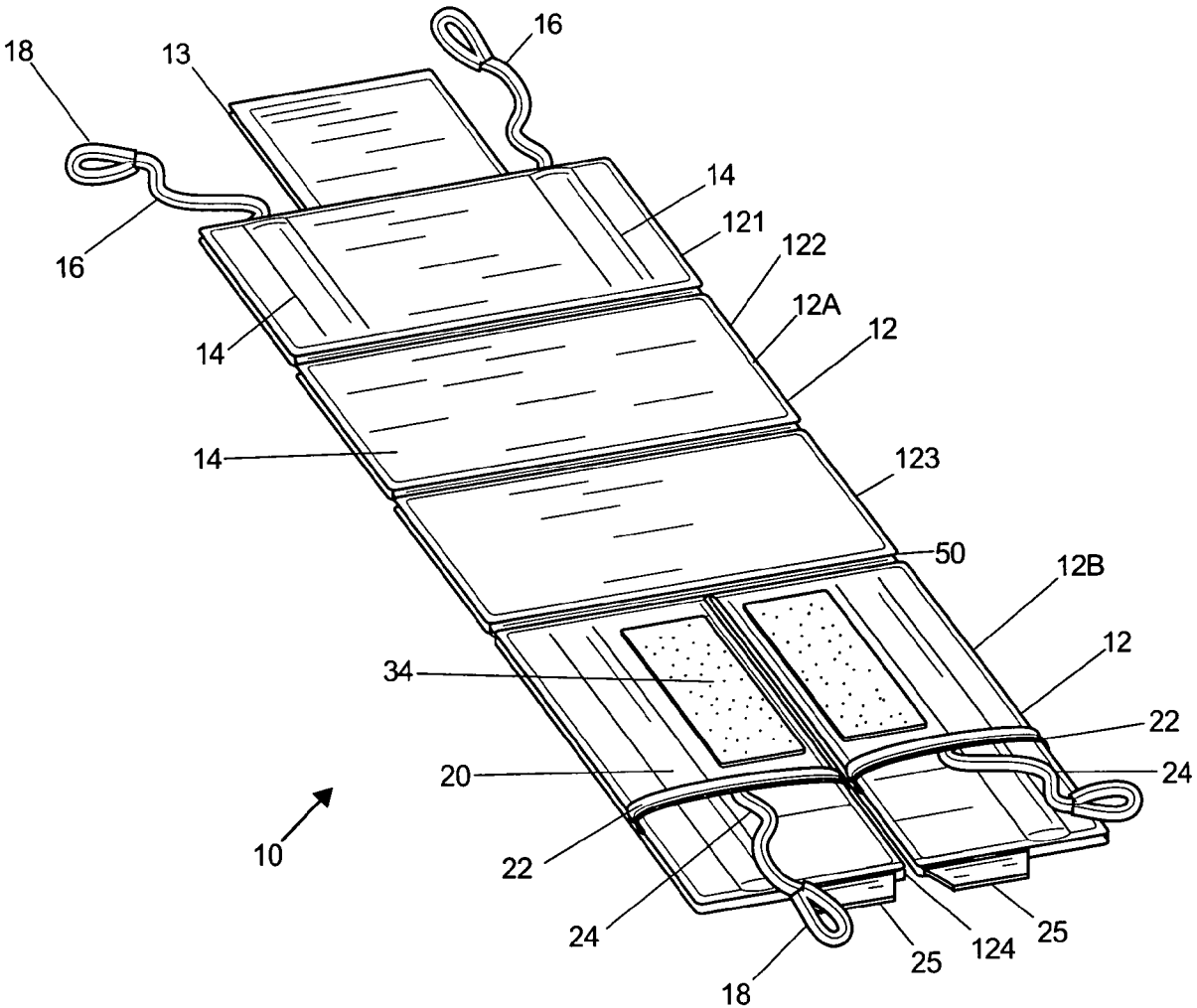
FIG. 1 is a diagrammatic perspective view of the exercise device of the present invention having an upper and a lower mat, which are hingedly connected together at a hinge for cushioning and supporting the body during workouts.

FIG. 1 illustrates a portable exercise device 10 for cushioning and supporting a body of a user while exercising and developing arm, leg, back, and abdominal muscles and reducing fat around the stomach and abdominal area.

The exercise device 10 has two, equally sized, rectangular mats 12, including an upper 12A and a lower mat 12B, which are hingedly connected at a hinge 50, for cushioning and supporting the body while exercising and developing arm, leg, back, and abdominal muscles and reducing fat around the stomach and abdominal area. The upper 12A and lower mats 12B are together preferably sized to be "full length", allowing a person to lay upon the device 10 and have the mats extend fully beneath them—from the bottom of their feet to the top of their head. The upper and lower mats 12A and 12B fold in half along the hinge 50 for easy transport and storage. The mats 12 are preferably made in various sizes for accommodating different shaped bodies. In addition, the upper mat 12A has three segments 121, 122, 123 that allow the upper mat 12A to conform to the spine as it is flexed. Further, the lower mat 12B has a longitudinal split 124 that allows the legs to be lifted independently—such as while performing leg lifts.

The exercise device 10 is capable of supporting the neck while doing sit-ups. The upper mat 12A of the invention is equipped with two internally positioned, flexible fiberglass shafts 14 and two top straps 16. The flexible fiberglass shafts support the muscles immediately adjacent to the spine. In addition, the upper mat 12A includes an outwardly extending head support panel 13. The shafts 14 function as a neck support and anchor for the two straps 16 which are grasped by the user during sit-up exercises. The shafts 14 are preferably two inches in width and are spaced approximately six inches apart within the upper mat 12A in order to clear a spine of the user while exercising. The two top straps 16, which are preferably adjustable, are made of will give slightly when pulled upwardly thereon by the user, extend upwardly from the upper mat 12A. The two straps 16 each include a handle grip 18 for comfortable grasping by the user while doing sit-ups.

The exercise device 10 is also capable of being used for leg lifts and stretches. The lower mat 12B of the invention has two internally positioned, non-flexible shafts 20, two feet straps 22, and two grasping straps 24. The two feet straps 22, preferably made of nylon, are adjustable and hold a feet of the user during sit-ups, leg-lifts, and stretches. The feet straps 22 preferably extend across the shins and can adjust to extend over the toes. The grasping straps 24 are attached along the two feet straps 22 and are used for leg lifts and hip stretches. The grasping straps 24 are preferably made of rubber for easily stretching and giving. The grasping straps 24 also include handle grips 18.

To ballast the user while performing sit-ups, the lower mat has a pair of metal tabs 25. The metal tabs 25 can be slid under a door to help keep the lower mat 12A anchored against the ground while the user performs sit-ups.

Figure 2:
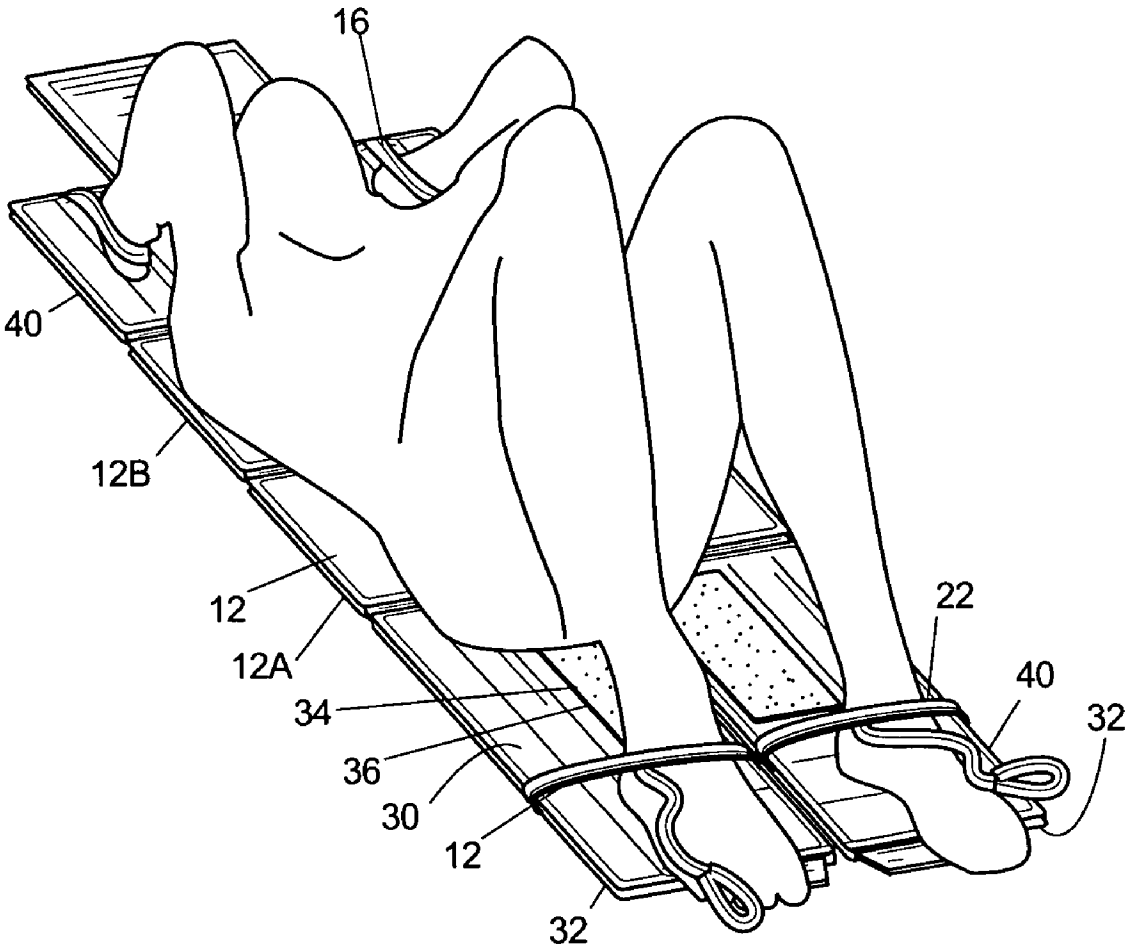
FIG. 2 is a diagrammatic perspective view of the exercise device of the present invention in use wherein a user is lying against the mats and beginning a sit up.

Referring to FIG. 2, the mats 12 include a top surface 30, a bottom surface 32, and side edges 40. Centrally positioned along the top surface of the mats 12 centrally between the upper and lower mats 12A and 12B is a non-skid covering 34 for preventing of the user from sliding during workouts. In addition, the bottom surface 32 of the mats 12 also contains non-skid covering 36 for preventing the mats 12 from moving during workouts, shown in FIG. 2.

Figure 4:
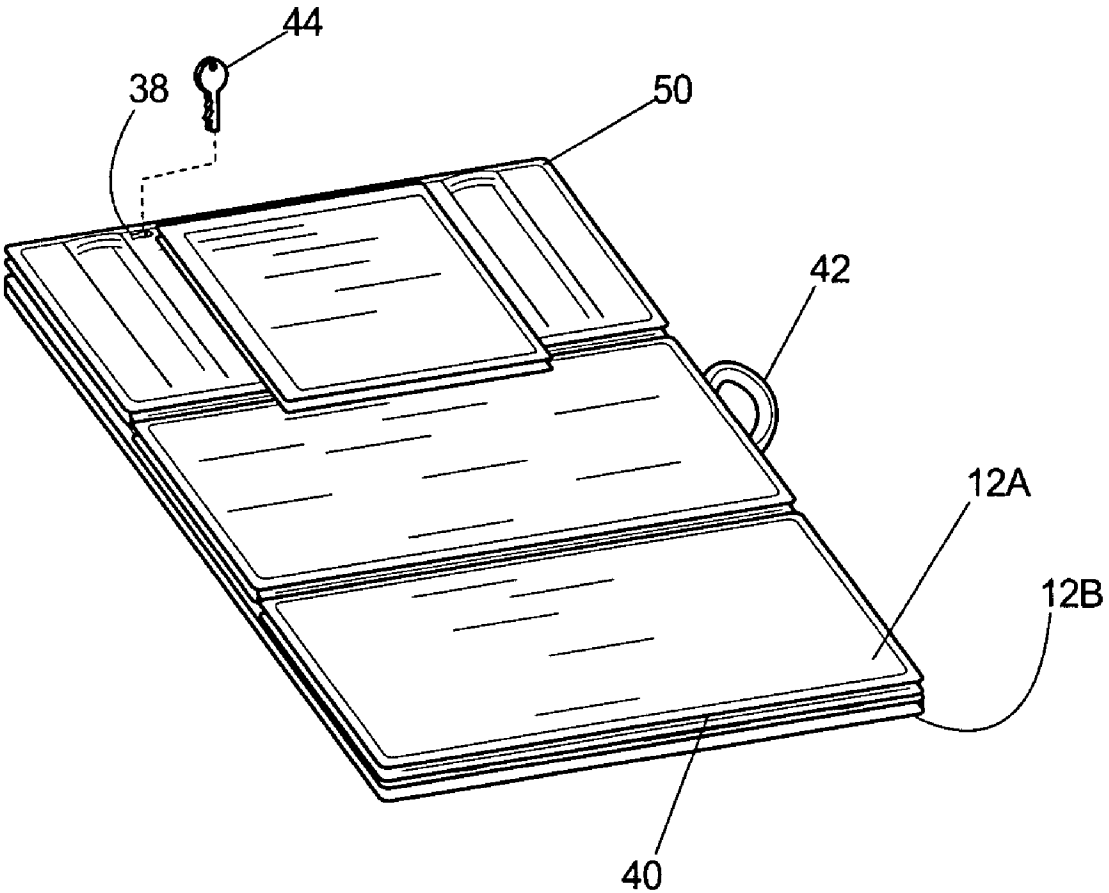
FIG. 4 is a top plan view of the mats of the exercise device of the present invention being folded up into a compact, briefcase configuration for easy transport and storage.

FIG. 4 illustrates the mats 12 folded into a compact, briefcase-like configuration for easy transport and storage. Both the upper and lower mats 12A and 12B each include two locking holes 38 which extend therethrough. The upper and lower mats 12A and 12B easily fold in half along hinge 50. When folded in half, the locking holes of the upper mat 12A align with the locking holes 38 of the lower mat 12B. A key 44, preferably plastic is inserted within the locking holes for locking and unlocking the upper and lower mats 12A and 12B together for prohibiting use. A handle 42 is attached along one of the side edges 40 of the mats 12 for easily lifting and carrying the exercise device 10.

Figure 3:
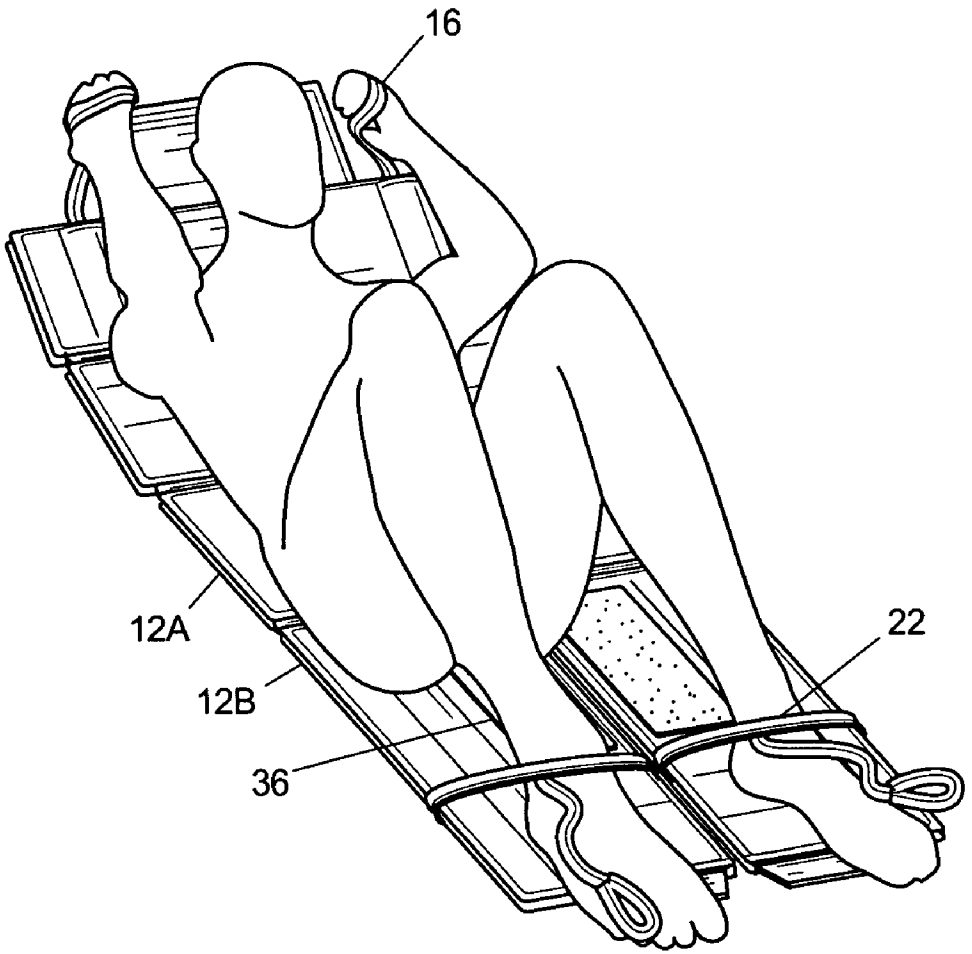
FIG. 3 is a side elevational view of the exercise device of the present invention in use wherein a user is lying against the mats and completing a sit up.

FIGS. 2 and 3 illustrate the exercise device 10 in use exercising abdominal muscles while doing sit ups. First, a user spreads out the exercise device 10 on a flat surface. Then, the user then lies with their back downwardly on the upper and lower mats 12A and 12B such that their buttocks are positioned above the non-skid covering 34 and their head is positioned above the head support panel 13. Then the user positions their feet within the feet straps 22 and bends their knees as shown. Then the user grasps the handle grips 18 of the two straps 16 and performs a sit up, leading with arms, as usual by lifting upwardly using their abdominal muscles to complete and once the abdominal muscle has contracted, slowing lying back downwardly to relax the muscle. The exercise is repeated for as many times as desired.

The exercise device 10 may be used in numerous ways to accomplish different exercise goals. In particular, the exercise device can be used for performing neck crunches, buttock and thigh stretches, and for working on the chest area. In addition, various adaptations can be made to accommodate people with injuries. For example, if the user needs help, a chair can be used or a trainer will stand over the user. In addition, the mat can be configured as a one-person mat (as shown), or as a two person mat for use by a person that is heavy or injured. Further, the mat can be used such that one person sits across the other person, and they will both get an upper body workout.

In conclusion, herein is presented an exercise device for cushioning and supporting a user while exercising and developing arm, leg, back, and abdominal muscles and reducing fat around the stomach and abdominal area. The invention is illustrated by example in the drawing figures, and throughout the written description. It should be understood that numerous variations are possible, while adhering to the inventive concept. Such variations are contemplated as being a part of the present invention.

What is claimed is:

1. A portable exercise device for cushioning and supporting a body of a user, having buttocks, while exercising and developing arm, leg, back, and abdominal muscles and reducing fat around the stomach and abdominal area, comprising:

a pair of equally sized rectangular mats including an upper and a lower mat having a hinge connection for folding in half, having a top surface, a bottom surface, and side edges, having a non-skid covering centrally positionable along the top surface between the upper and lower mats for preventing the buttocks of the user from sliding during workouts, having a non-skid covering along bottom surface of said mats for preventing the mats from moving during workouts, the upper mat having two internally positioned flexible shafts, two adjustable straps extend upwardly from the upper mat, and an outwardly extending head support panel, the two straps each having a handle grip for grasping by the user, the lower mat having two internally positioned, non-flexible shafts, two adjustable feet straps, and two grasping straps having handle grips for grasping by the user, the upper and lower mats each include two locking holes extending therethrough which align when the upper and lower mats are folded in half, the lower mat a longitudinal split and having two metal tabs for anchoring the lower mat below a fixed objecthaving a handle attaching along one of the side edges; and a key for inserting within the locking holes for locking and unlocking the upper and lower mats.

2. A portable exercise device for cushioning and supporting a body of a user, having buttocks, while exercising and developing arm, leg, back, and abdominal muscles and reducing fat around the stomach and abdominal area, comprising:

a pair of equally sized rectangular mats including an upper and a lower mat having a hinge connection for folding in half, having a top surface, a bottom surface, and side edges, the upper mat having two internally positioned flexible shafts, two top straps extending upwardly from the upper mat, and an outwardly extending head support panel, the lower mat having a longitudinal split, two internally positioned, non-flexible shafts, two adjustable feet straps, two metal tabs for extending under a fixed object for anchoring the lower mat, and two grasping straps.

3. The portable exercise device of claim 2, further comprising a non-skid covering centrally positioned along the top surface between the upper and lower mats for preventing the buttocks of the user from sliding during workouts.

4. The portable exercise device of claim 3, wherein the lower mat has a longitudinal split for allowing the legs to raise independently when attached thereto.

5. The portable exercise device of claim 4, wherein the two straps of the upper mat each include a handle grip for grasping by the user.

6. The portable exercise device of claim 5, wherein the two grasping straps each have handle grips for grasping by the user.

7. The portable exercise device of claim 6, wherein the upper and lower mats each include two locking holes extending therethrough which align when the upper and lower mats are folded in half.

8. The portable exercise device of claim 7, further comprising a handle attached along one of the side edges of the upper or lower mat.

9. The portable exercise device of claim 8, further comprising a key for insertion within the locking holes for locking and unlocking the upper and lower mats.

* * * * *